United States Patent [19]

Anderson

[11] 4,429,910

[45] Feb. 7, 1984

[54] WINDOW LOCK

[75] Inventor: Donald L. Anderson, Owatonna, Minn.

[73] Assignee: Truth Incorporated, Owatonna, Minn.

[21] Appl. No.: 309,562

[22] Filed: Oct. 8, 1981

[51] Int. Cl.[3] ..... E05C 3/06

[52] U.S. Cl. ..... 292/199; 292/DIG. 33

[58] Field of Search ..... 292/DIG. 33, 199, 200, 292/226, 240, 244

[56] References Cited

U.S. PATENT DOCUMENTS

| | | | |
|---|---|---|---|
| 554,448 | 2/1896 | Keil . | |
| 865,090 | 9/1907 | Eddy | 292/226 |
| 2,136,408 | 11/1938 | Bedell | 292/199 X |
| 2,326,084 | 8/1943 | Westrope | 292/226 |
| 2,789,851 | 4/1957 | Lickteig | 292/98 |
| 2,891,816 | 6/1959 | Meats | 292/200 X |
| 2,948,560 | 8/1960 | Rop | 292/200 X |
| 4,059,298 | 11/1977 | Van Klompenburg | 292/199 |
| 4,127,016 | 11/1978 | Ibsen | 292/200 X |

FOREIGN PATENT DOCUMENTS

| | | | |
|---|---|---|---|
| 1043135 | 11/1958 | Fed. Rep. of Germany | 292/200 |
| 83363 | 5/1935 | Sweden | 292/240 |

*Primary Examiner*—Thomas J. Holko
*Assistant Examiner*—R. Illich
*Attorney, Agent, or Firm*—Wood, Dalton, Phillips, Mason & Rowe

[57] ABSTRACT

A window lock operable in association with either a right-hand or left-hand casement window having a cam movable to either one of two different lock positions relative to a keeper mounted on a window sash. One lock position is operative when the window lock is used with a right-hand casement window and the other lock position is operative when the window lock is used with a left-hand casement window. The movement of the cam is effected by a handle connected thereto by structure including connection means providing a mechanical advantage in movement of the cam by the handle.

7 Claims, 9 Drawing Figures

20
21
35a
75
60
64
63
61
37
45
70
35
12
76
66
30
65
71
8.

22
32
40
8.
72
46
71
65
20
75
47
30
41
23

21
31
11
32
30

23
25
30
41
12
76
72
37
36
35
65
21
63
46
62
48
35a
36
26
47
22
49
45
42

WINDOW LOCK

BACKGROUND OF THE INVENTION

This invention pertains to a window lock for casement windows operable with either a right-hand or left-hand casement window.

A commercially-successful casement window lock is shown in Van Klompenburg U.S. Pat. No. 4,059,298, owned by the assignee of this application. The window lock has a cam mounted within a casing which is moved both bodily and rotatably into position behind a keeper carried by a window sash and in moving to a lock position the cam draws the keeper and sash into a tightly-closed position. In casement window locks which are normally mounted on a vertical part of the window frame, it is conventional to have the operating handle in a down position when the window is locked. Since casement windows are both right-hand and left-hand, referring to the side of the window on which the vertical pivoting axis for the window is located, it is necessary to have structures of the type shown in the patent built in two different embodiments for mounting at either the right or left-hand side of the window frame which results in increasing the inventory requirements for the window lock.

Additionally, considerable force may be required in tightly closing the window and reducing the effort required to operate the window lock would be an improvement.

SUMMARY OF THE INVENTION

Primary features of the invention disclosed herein are to provide: a window lock for a casement window which provides good locking action and which is constructed for mounting in association with either a right-hand or left-hand casement window by having two lock positions with the operating handle extending downwardly in both of said lock positions; and a window lock with structure providing a mechanical advantage in moving the window sash to locked position.

A primary object of the invention is to provide a casement window lock having a cam engageable with a keeper mounted on a window sash and with the cam movable to either of two lock positions at two opposite limits of movement of an operating handle, whereby the lock can be associated with either a right-hand or left-hand casement window and the handle will always extend downwardly when the cam is in an operative lock position.

Another object of the invention is to provide an improvement in a casement window lock having a cam operable to engage a keeper carried on the window sash and draw the window tightly closed wherein a handle is provided for moving the cam and connection means between the handle and cam include relatively movable parts providing a mechanical advantage in movement of the cam by the handle.

A further object of the invention is to provide a window lock operable in association with either a right-hand or a left-hand casement window including a casing mountable on the frame of the window and having a keeper-receiving opening and a keeper mountable on the sash in either of two positions offset from the center of said keeper-receiving opening, a cam within the casing having a pair of locking surfaces positionable alternately one at each of a pair of lock positions to engage the keeper and which are offset from the center of said keeper-receiving opening, means mounting the cam for bodily movement between said pair of lock positions and means rotatably mounting said cam on said mounting means, and means for bodily moving said cam from one lock position to the other and simultaneously rotating said cam to move one of the locking surfaces behind the keeper and, thereafter, draw the keeper further into the casing for tightly closing the window.

DESCRIPTION OF THE PREFERRED EMBODIMENT

Figure 1:
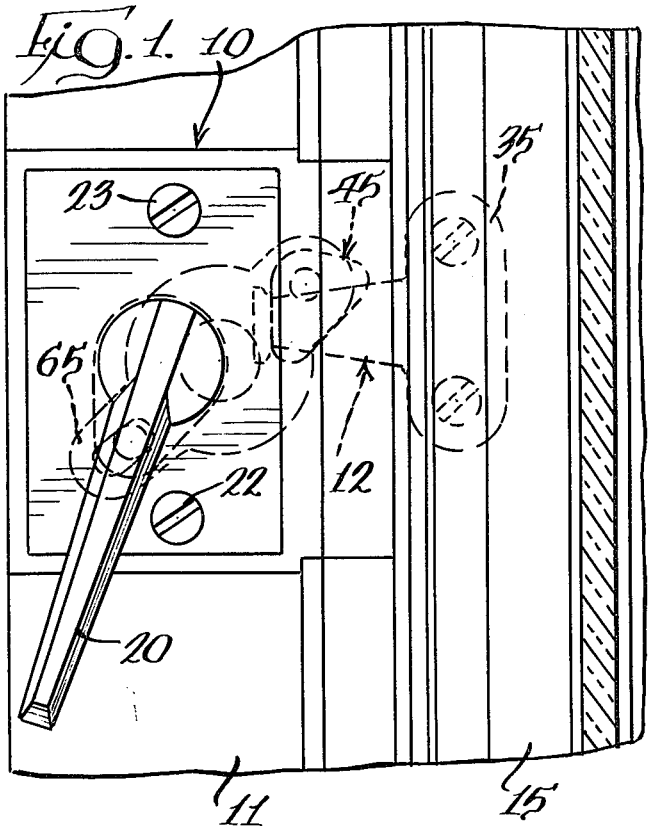
FIG. 1 is a fragmentary side elevational view of a left-hand casement window showing the window lock in locked position and with a part of the window sash in section.
Figure 2:
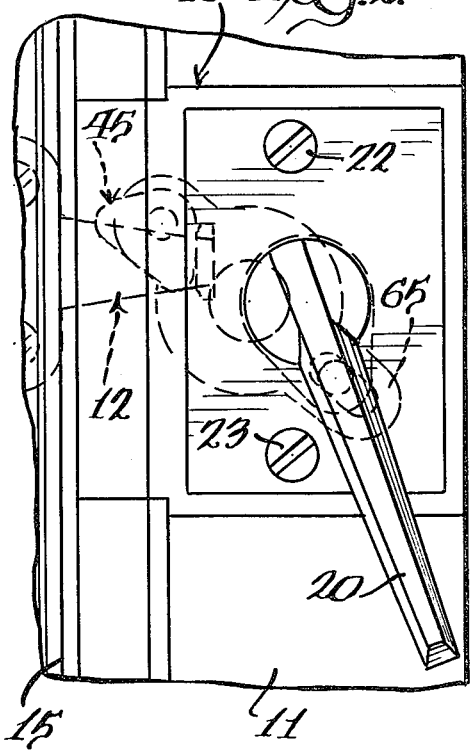
FIG. 2 is a fragmentary side elevational view of a right-hand casement window showing the window lock in locked position.

The casement window lock disclosed herein is non-handed, in that it can be used with either a left-hand or right-hand casement window, with these two mountings being shown in FIGS. 1 and 2, respectively. The window lock, indicated generally at 10, is mounted on a vertical part 11 of the window frame for coaction with a keeper, generally indicated at 12, which is mounted on a window sash 15. A movable handle 20 has a downwardly-extending lock position when the window lock is mounted in association with a left-hand window, as seen in FIG. 1, and, as seen in FIG. 2, the handle 20 also has a downwardly-extending lock position when associated with a right-hand window.

The window lock has an enclosing casing 21 secured to the window frame part 11 by a pair of screws 22 and 23. The casing has a depending flange 24 with a pair of motion-limiting abutments 25 and 26 for a purpose to be described.

Figure 8:
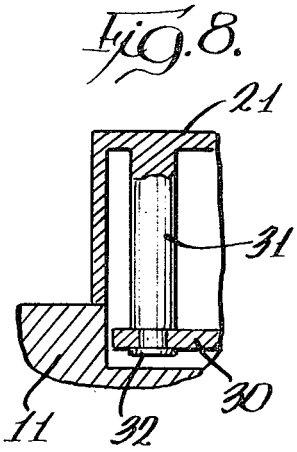
FIG. 8 is a fragmentary section, taken generally along the line 8—8 in FIG. 7.

A back plate 30 is attached to the casing 21 at a number of locations, in the manner shown particularly in FIG. 8, particularly by integral depending members 31 having a reduced diameter section extending through an opening in the base plate and a headed end 32 which secures the base plate 30 thereto.

The keeper 12 is formed of generally planar stock and has an elongate end 35 secured to the window sash by screws 36. A generally U-shaped keeper section **35*a* extends from the elongate part 35 thereof with a flange 37 defined by a leg thereof. One side of the casing 21 has parts 40 and 41 which terminate at a distance from each other to provide a keeper-receiving opening of substantial height whereby the keeper may enter into the window lock casing adjacent the casing side part 41 when the window lock is used with a left-hand window, as shown in FIGS. 1 and 4, and may enter into the opening adjacent the casement side part 40 when the window lock is used with a right-hand window, as shown in FIG. 2**.

Figure 3:
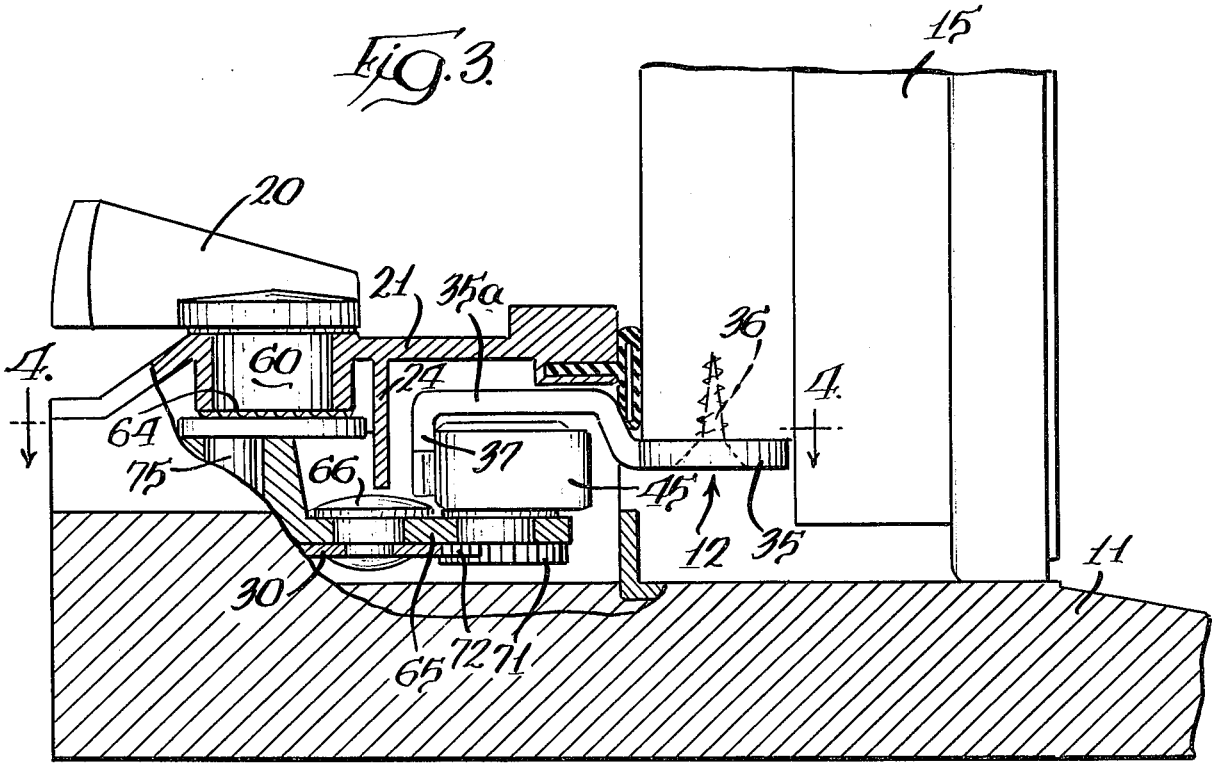
FIG. 3 is a view of the structure shown in FIG. 1, on an enlarged scale looking toward the lower side of the window lock as seen in FIG. 1 and with parts of the window lock casing and window sill broken away.
Figure 4:
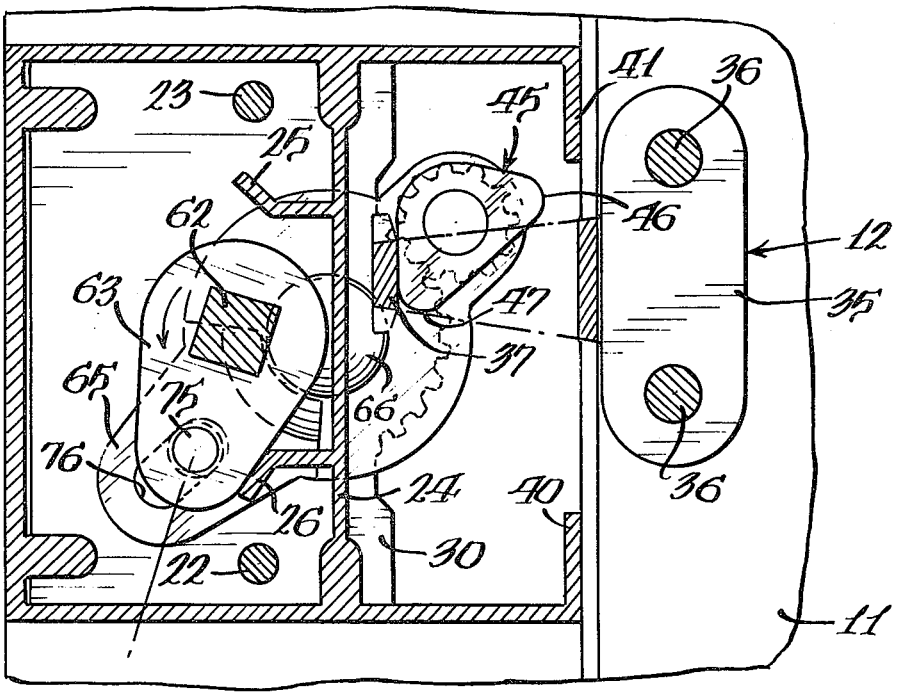
FIG. 4 is a plan section, taken generally along the line 4—4 in FIG. 3.
Figure 9:
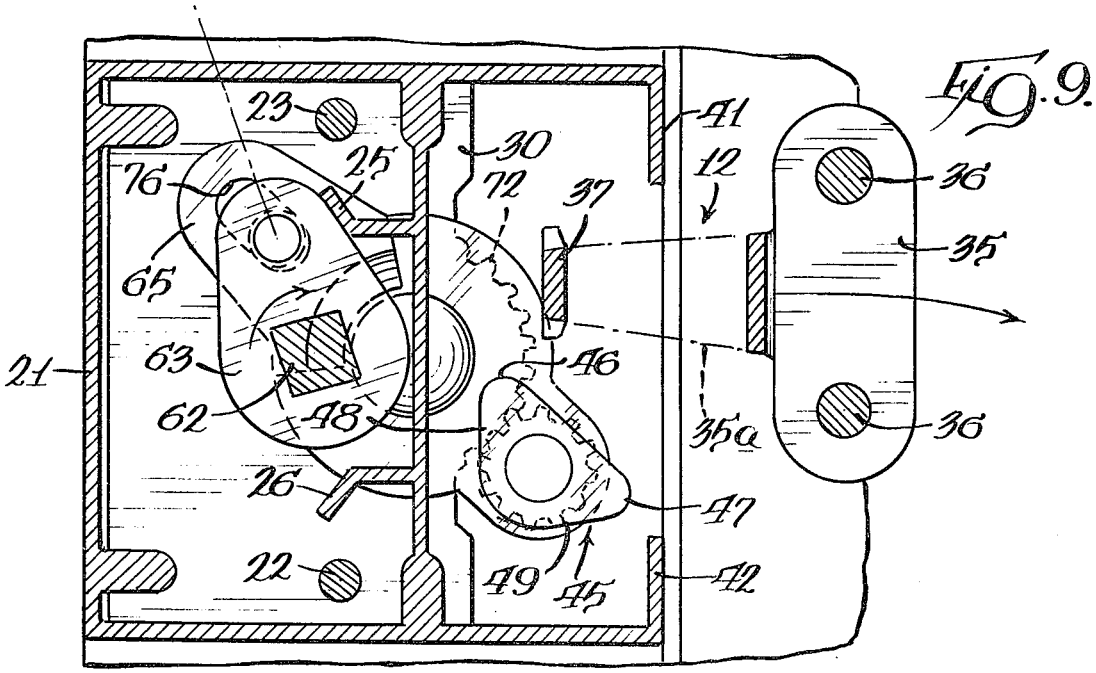
FIG. 9 is a view, similar to FIG. 4, showing the mechanism positioned in the other of its lock positions.

A generally triangularly-shaped cam, indicated generally at 45, is mounted within the casing for movement to either of two lock positions, with one lock position being shown in FIGS. 1, 3 and 4 and the other lock position being shown in FIGS. 2 and 9. The cam 45 has a pair of rounded corners 46 and 47, with a pair of lock surfaces 48 and 49 extended therefrom.

With the window lock mounted in association with a left-hand window, as seen in FIG. 1, the cam 45 is shown in FIG. 9 positioned in an inoperative lock position. In moving the cam to the lock position of FIGS. 1 and 4, the cam is moved bodily and also rotated to move to an intermediate center position, shown in FIG. 5, wherein it is positioned behind the keeper flange 37, even though the sash is not fully closed and the cam then moves to the lock position shown in FIG. 4 and, during this movement, the rounded corner 47 engages behind the keeper flange and, in final position, the cam lock surface 49 abuts the keeper flange. It will be noted that the keeper 12 is mounted offset from the center position of the cam, as viewed in FIG. 5.

Movement is imparted to the cam 45 by operative connections between the cam and the handle 20 which provide a mechanical advantage whereby the effort required to move the cam and keeper to final lock position is minimized. The handle 20 is rotatably-mounted within the casing by a cylindrical part 60 thereof rotatably fitted in an opening 61 in the casing. The inner end of the cylindrical part 60 has a squared end 62 to which a drive member 63 is staked for rotation with the handle. A spring washer 64 is interposed between the drive member and the part of the casing defining the opening 61. Rotation of the handle 20 causes rotation of the drive member 63 to impart rotation to an actuator member 65 which is rotatably mounted on the base plate 30 at a pivot axis defined by a rivet 66. The actuator member 65 rotatably mounts the cam 45 for rotation about an axis at a distance from the pivot axis for the actuator member. The cam 45 has a cylindrical part 70 fitted within an opening in the actuator member and, at the opposite side of the actuator member, has a gear 71 fixed thereto which meshes with a sector gear 72 extending along an arcuate part of the base plate 30.

The actuator member 65 is rotated by rotation of the drive member 63 through connection means providing a mechanical advantage in moving the cam to a lock position. This connection means comprises a relatively movable pin and slot connection between the drive member 63 and the actuator member 65 located at a side of the pivot axis defined by the rivet 66 which is opposite from the axis of rotation of the cam 45. More particularly, a pin 75 extends from the actuator plate 63 and is movable in an elongate slot 76 formed in the actuator member 65.

Figure 5:
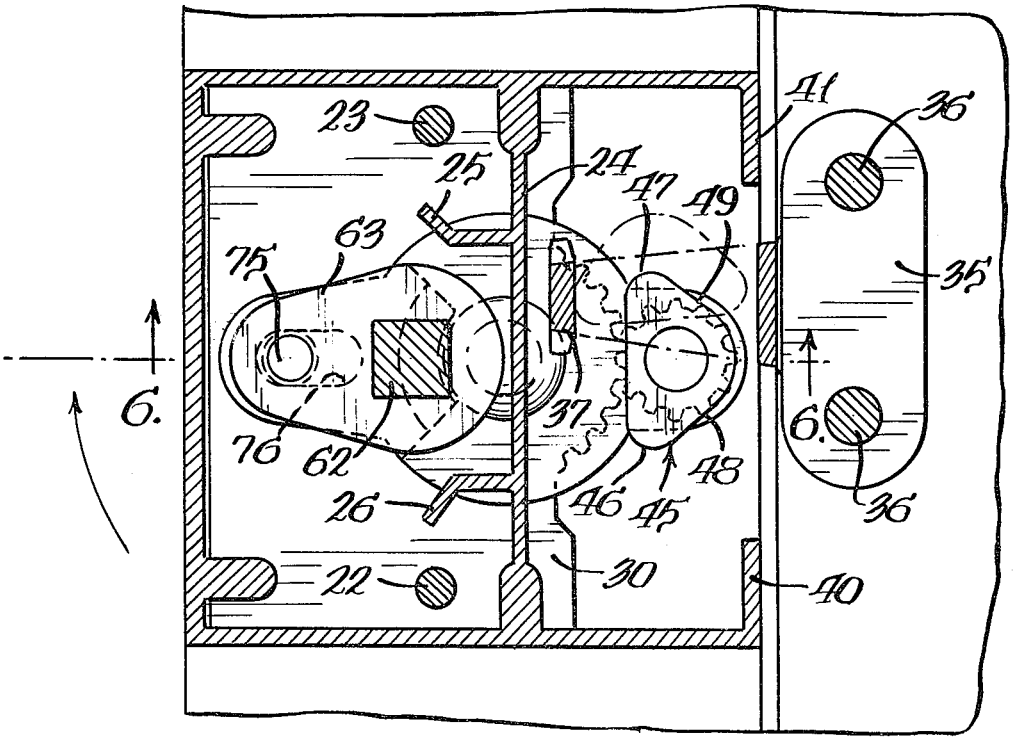
FIG. 5 is a view, similar to FIG. 4, showing the structure of the window lock in an intermediate position.
Figure 6:
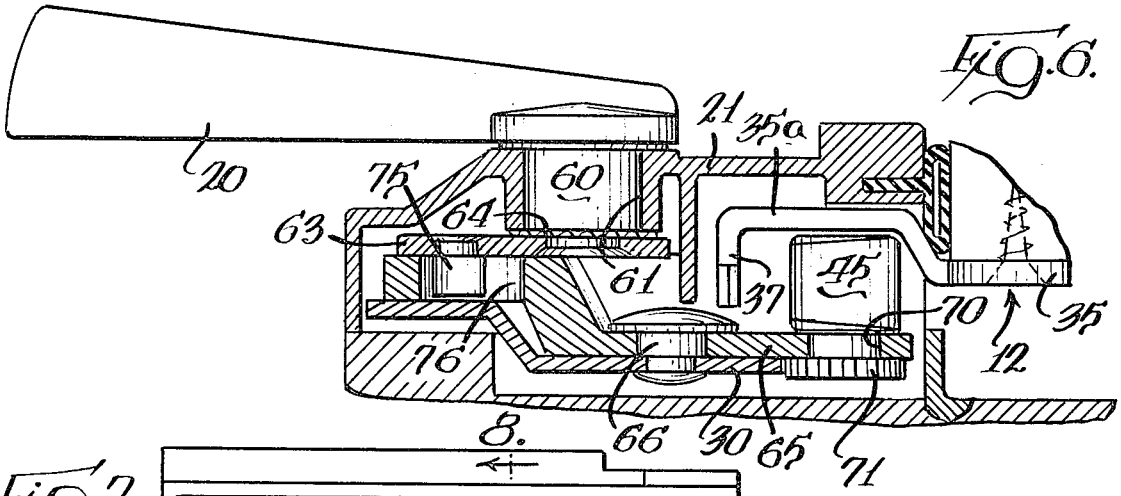
FIG. 6 is a section, taken generally along the line 6—6 in FIG. 5.
Figure 7:
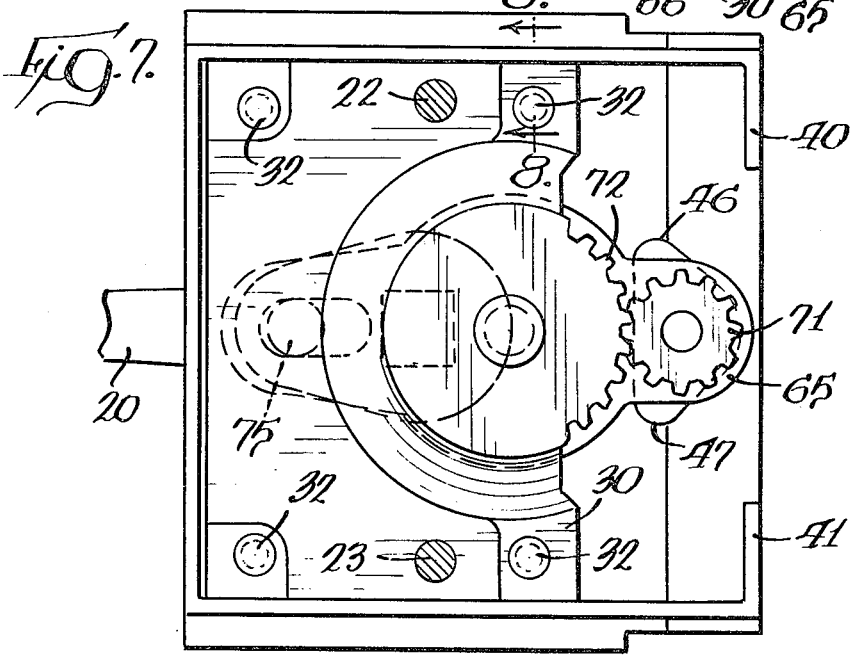
FIG. 7 is a sectional view of the window lock positioned as shown in FIGS. 5 and 6 and looking toward the underside thereof.

With the window lock mounted for use with a left-hand window, as shown in FIG. 1 and in unlocked position, the structure is positioned as shown in FIG. 9. In this position, the handle 20 is extending upwardly. A counterclockwise rotation of the handle towards the lock position of FIG. 1 causes rotation of the drive member 63 and, through the pin and slot connection, rotation of the actuator member 65. An intermediate position is shown in FIG. 5 and, as the mechanism continues to move toward locked position, the rounded corner 47 of the cam engages behind the keeper flange 37 to move the keeper further inwardly of the casing 21. This movement of the cam is by bodily movement because of being carried on the actuator member 65 and also by rotation caused by the mesh of the gear 71 and the gear section 72. In the final movement of the cam to the position shown in FIG. 4, the locking surface 49 engages the back side of the keeper flange 37 and the rotational movement is terminated by engagement of the drive member 63 with the motion-limiting abutment 26 of the casing.

When the window lock is associated with a right-hand window, the locked position is shown in FIG. 2 with the handle 20 extending downwardly. In this mode of operation, the unlocked position has the handle 20 extending upwardly and the mechanism within the casing would be positioned as shown in FIG. 4, except that the keeper 12 would be lowered relatively as seen in the Figure whereby, as the handle 20 rotates in a clockwise direction from unlocked to locked position, the cam is caused to leave the position shown in FIG. 4, travel through the center position, shown in FIG. 5, and reach a lock position, shown in FIG. 9 wherein the locking surface 48 engages behind the keeper flange 37. It will be appreciated that in both mountings of the window lock, the keeper 12 is mounted above the center position of the cam 45.

With the window lock disclosed herein, it is possible to have a single structure which is non-handed and thus usable with either a left-hand or right-hand window, with the handle extending downwardly when the window lock is in lock position, and has a cam which is moved both bodily and rotated to a position to engage behind a keeper and draw the keeper further into the casing to tightly close the window. The operation is facilitated by the mechanical advantage achieved in the mechanism for operating the cam to minimize the effort required to lock the window.

I claim:

1. A window lock having a pair of lock positions at opposite ends of movement of a handle whereby the handle may be in a down locked position when the window lock is associated with either a right-hand or left-hand casement window including a casing mountable on the frame of the window and having a keeper-receiving opening and a keeper mountable on the sash in either of two positions offset from the center of said keeper-receiving opening, a generally triangular cam within the casing having a pair of rounded corners and lock surfaces extended therefrom and having two different lock positions at opposite sides of a center position at the center of said keeper-receiving opening, means for bodily moving said cam between said lock positions, and means for rotating said cam to move a rounded corner thereof toward the keeper in the casing and bring a lock surface into contact with the keeper as the cam moves from said center position to said lock position.

2. A window lock having a casing and a separate keeper with a flange movable to a locking position within the casing, a cam within said casing and which has a pair of locking surfaces positionable alternately one at each of a pair of lock positions to engage said keeper, means mounting said cam for bodily movement between said pair of lock positions located one at either side of a center position, means rotatably mounting said cam on said mounting means, and means for bodily moving said cam from one lock position to the other and simultaneously rotating said cam to move one of the locking surfaces against said keeper flange.

3. A window lock comprising a keeper, a casing having an opening to receive the keeper and a rotatable handle for moving a cam within the casing into locked relation with the keeper, an actuator member mounted within the casing for pivotal movement about a pivot axis between two lock positions at opposite sides of a center position, said cam being mounted on said actuator member for rotation about a second axis at a distance from said pivot axis, means for causing rotation of the cam as the cam moves with the actuator member during pivoting of the actuator member, said cam having a generally triangular shape with a pair of locking sections with a pair of lock surfaces angularly diverging from each other and at generally equal angles to a line normal to the casing opening when the actuator member is in the center position, said locking sections being alternately operable one at each of said lock positions with the bodily movement of the cam moving one of the locking sections behind the keeper at the center position of the actuator member and continued movement of the actuator member causing the last-mentioned locking section to move in a direction to force the keeper into the casing as a combination of cam rotation and bodily movement, and connection means between said handle and the actuator member.

4. A window lock comprising a keeper, a casing having an opening to receive the keeper and a rotatable handle for moving a cam within the casing into locked relation with the keeper, an actuator member mounted within the casing for pivotal movement about a pivot axis between two lock positions at opposite sides of a center position, said cam being mounted on said actuator member for rotation about a second axis at a distance from said pivot axis, means for causing rotation of the cam as the cam moves with the actuator member during pivoting of the actuator member, said cam having a generally triangular shape with a pair of locking sections alternately operable one at each of said lock positions with the bodily movement of the cam moving one of the locking sections behind the keeper at the center position of the actuator member and continued movement of the actuator member causing the last-mentioned locking section to move in a direction to force the keeper into the casing as a combination of cam rotation and bodily movement, and connection means between said handle and the actuator member providing a mechanical advantage in movement of the actuator member including a drive member rotatable with the handle, and a relatively movable pin and slot connection between the drive member and actuator member located at a side of the pivot axis opposite said second axis.

5. A window lock having a pair of lock positions at opposite ends of movement of a handle whereby the handle may be in a down locked position when the window lock is associated with either a right-hand or left-hand casement window including a casing mountable on the frame of the window and which has a keeper-receiving opening, an actuator member, means pivotally mounting the actuator member on the casing intermediate opposite ends of the actuator member for rotation about an actuator member axis to move between two lock positions, a cam mounted on the actuator member adjacent one end thereof for rotaton about a cam axis spaced from the actuator member axis, said cam having two external surfaces defining lock surfaces which are angularly related to each other, a fixed sector gear on the casing coaxial with the actuator member axis, a gear rotatably fixed to the cam and in mesh with said fixed sector gear, and a drive mechanism for the actuator member, said actuator member having a central position intermediate said lock positions wherein said axes are in alignment and extend along a line which is normal to the keeper-receiving opening and the two lock surfaces of the cam are at opposite sides of said line passing through said axes and diverging at substantially equal angles therefrom.

6. A window lock having a pair of lock positions at opposite ends of movement of a handle whereby the handle may be in a down locked position when the window lock is associated with either a right-hand or left-hand casement window including a casing mountable on the frame of the window and which has a keeper-receiving opening, an actuator member, means pivotally mounting the actuator member on the casing intermediate opposite ends of the actuator member for rotation about an actuator member axis to move between two lock positions, a cam mounted on the actuator member adjacent one end thereof for rotation about a cam axis spaced from the actuator member axis, said cam having two external surfaces defining lock surfaces which are angularly related to each other, means for rotating the cam as the actuator member pivots, a pin and slot drive mechanism for the actuator member having one of said pin and slot associated with the actuator member adjacent the other end thereof, and a drive member having the other of said pin and slot and pivotally mounted on the casing for rotation about a drive member axis located between the pin and slot drive mechanism and the actuator member axis, said actuator member having a central position equidistant between said lock positions wherein said axes are in alignment and the two lock surfaces of the cam are at opposite sides of a line passing through said axes and diverging at substantially equal angles therefrom.

7. A window lock having a pair of lock positions at opposite ends of movement of a handle whereby the handle may be in a down locked position when the window lock is associated with either a right-hand or left-hand casement window including a casing mountable on the frame of the window and which has a keeper-receiving opening, an actuator member, means pivotally mounting the actuator member on the casing intermediate opposite ends of the actuator member for rotation about an actuator member axis to move between two lock positions, a cam mounted on the actuator member adjacent one end thereof for rotation about a cam axis spaced from the actuator member axis, said cam having at least one lock surface, a fixed sector gear on the casing coaxial with the actuator member axis, a gear rotatably fixed to the cam and in mesh with said fixed sector gear, a pin and slot drive mechanism for the actuator member having one of said pin and slot associated with the actuator member adjacent the opposite end thereof, and a drive member having the other of said pin and slot and pivotally mounted on the casing for rotation about a drive member axis located between the pin and slot drive mechanism and the actuator member axis.

* * * * *